US006417702B1

(12) United States Patent
Wang

(10) Patent No.: US 6,417,702 B1
(45) Date of Patent: Jul. 9, 2002

(54) MULTI-MODE CURRENT-TO-VOLTAGE CONVERTER

(75) Inventor: Chunyan Wang, Montréal (CA)

(73) Assignee: Concordia University, Montreal (CA)

( * ) Notice: Subject to any disclaimer, the term of this patent is extended or adjusted under 35 U.S.C. 154(b) by 1 day.

(21) Appl. No.: 09/617,270

(22) Filed: Jul. 17, 2000

Related U.S. Application Data

(63) Continuation-in-part of application No. 09/549,206, filed on Apr. 13, 2000.
(60) Provisional application No. 60/129,036, filed on Apr. 13, 1999.

(51) Int. Cl.[7] ..... G05I 3/02
(52) U.S. Cl. ..... 327/103; 327/541; 327/543; 327/334
(58) Field of Search ..... 327/538, 540, 327/541, 334, 543, 103; 323/313, 315

(56) References Cited

U.S. PATENT DOCUMENTS

| | | | | |
|---|---|---|---|---|
| 3,835,410 A | * | 9/1974 | Wittlinger | 327/540 |
| 3,925,718 A | * | 12/1975 | Wittlinger | 327/540 |
| 4,354,122 A | * | 10/1982 | Embree et al. | 323/316 |
| 4,882,533 A | * | 11/1989 | Kelley | 323/313 |
| 5,057,792 A | * | 10/1991 | Gay | 323/315 |
| 5,252,909 A | * | 10/1993 | Aizaki | 323/313 |
| 5,293,058 A | | 3/1994 | Tsividis | |
| 5,818,213 A | * | 10/1998 | Kim | 323/315 |
| 5,838,188 A | * | 11/1998 | Taguchi | 327/539 |
| 6,107,868 A | * | 8/2000 | Diniz et al. | 327/543 |
| 6,194,956 B1 | * | 2/2001 | Barnes | 327/538 |

OTHER PUBLICATIONS

Measurement and Modeling of Charge Feedthrough in n–Channel MOS Analog Switches, Wilson et al, IEEE Journal of Solid–State Circuits, vol. sc–20, No. 6, pp. 1206–1212, Dec. 1985.

Current Copier Cells, Daubert et al., Electronics Letters, vol. 24, No. 25, pp. 1560–1562, Dec. 8, 1988.

Very Linear CMOS Floating Resistor, Silva–Martinez et al., Electonics Letters, vol. 26, No. 19, pp. 1610–1611, Sep. 13, 1990.

Linear Tunable Resistance Circuit Using Gallium Arsenide MESFETs, Silva–Martinez et al., Electronics Letters, vol. 27, No. 8, pp. 655–657, Apr. 11, 1991.

Novel MOS Resistive Circuit for Synthesis of Fully Integrated Continuous–Time Filters, Z. Czarnul, IEEE Transactions on Circuits and Systems, vol. CAS–33, No. 7, pp. 718–721, Jul. 1986.

Low Power Current Comparator Cell for Weak Current Operations, C. Wang et al., IEEE ISCAS 2001, Sydney, Australia, pp. I–544–I–547.

An Adaptive Optical Sensor, C. Wang et al., ISCAS 2000 –IEEE International Symposium on Circuits and Systems, pp. IV–333–IV–336, May 28–31, 2000, Geneva, Switzerland.

(List continued on next page.)

*Primary Examiner*—Terry D. Cunningham
(74) *Attorney, Agent, or Firm*—James Anglehart; Ogilvy Renault

(57) ABSTRACT

A method and circuit are provided to perform current-to-voltage conversions. The circuit is operational in one linear mode based on channel-length-modulation effects in the saturation region and two non-linear modes based on a current operation overrunning the saturation region and a logarithmic function of drain current versus gate-to-source voltage, respectively. An adaptive process is provided to set-up the quiescent point of the circuit. The conversion gain is variable with respect to the conversion mode, the current range, and the length of the converting transistor.

19 Claims, 6 Drawing Sheets

OTHER PUBLICATIONS

Novel Voltage–Controlled Grounded Resistor, G. Wilson et al., Electronics Letters, vol. 25, No. 25 pp. 1725–1726, Dec. 7, 1989.

New CMOS Resistor Implementation for Linear IC Applications, P.M. Vanpetegham et al., Electronics Letters, vol. 24, No. 5, pp. 288–290, Mar. 3, 1988.

New CMOS Floating Voltage–Controlled Resistor, K. Nagaraj, Electronics Letters, vol. 22, No. 12, pp. 667–668, Jun. 5, 1986.

High Frequency Saturated CMOS Floating Resistor For Fully–Diffrential Analogue Signal Processors, M. Steyaert et al., Electronics Letters, vol. 27, No. 18, pp. 1609–1611. Aug. 29, 1991.

A New Floating Resistor for CMOS Technology, S.P. Singh, et al., IEEE Transactions on Circuits and Systems, vol. 36, No. 9, pp. 1217–1220. Sep. 1989.

Novel Electronically–Controlled Floating Resistors Using MOS Transistors Operating in Saturation, Z. Wang, Electronics Letters, vol. 27, No. 2, pp. 188–189, Jan. 17, 1991.

Floating Voltage–Controlled Resistors in CMOS Technology, M. Banu et al., Electronics Letters, vol. 18, No. 15, pp. 677–679, Jul. 22, 1982.

Optically Isolated Current–to–Voltage Convertor for an Electron Optics System, A. Band et al., Electron Physics Group, National Institute of Standards and Technology, 7 pages.

A Low–Voltage Low–Power Wide–Range CMOS Variable Gain Amplifier, A. Motamed et al., IEEE Transactions on Circuits and Systems –II: Analog and Digital Signal Processing, vol. 45, No. 7, pp. 800–811 Jul. 1998.

* cited by examiner

MULTI-MODE CURRENT-TO-VOLTAGE CONVERTER

This application is a continuation-in-part of application Ser. No., 09/549,206 filed Apr. 13, 2000, which claims priority of U.S. provisional patent application Ser. No. 60/129,036 filed Apr. 13, 1999.

FIELD OF THE INVENTION

The present invention relates to a method and apparatus for current-to-voltage conversion which is able to provide sensitive current-to-voltage detection for a small amplitude AC current signal, even if the AC current signal has a DC component which varies greatly over a very wide range.

BACKGROUND OF THE INVENTION

Existing approaches to current-to-voltage conversion in VLSI are usually based on:

(1) Charge integration. A current charging or discharging a capacitor during a given period transduces itself linearly into a voltage. This process introduces a delay that is the time required for the charge integration and is inversely proportional to the current. The dynamic range of the input current is usually below three decades. Moreover, the capacitor is a critical device as its capacitance should be voltage-independent.

(2) Characteristic of drain-to-source voltage versus drain current of a MOS transistor biased in the triode region. The equivalent resistance in this region is almost constant when the drain-to-source voltage is small, so it can be used for a linear current-to-voltage conversion. The conversion gain (output voltage over input current) is low, about a couple of milli-volts per micro-ampere. Thus, an input current varying in a nano-ampere range cannot be correctly converted. Furthermore, as the output voltage signal is small, an amplifier is usually required.

(3) Characteristic of gate-to-source voltage versus drain current of a MOS transistor biased in the saturation region. This feature makes a logarithmic conversion. The conversion gain of a logarithmic converter is of the order of one hundred millivolts per decade of current. Moreover, the logarithmic compression reduces the chance to detect current derivatives.

SUMMARY OF THE INVENTION

Accordingly, an object of the present invention is to provide a method and circuit for the realization of a highly sensitive current detector operational in a very wide dynamic range and capable of performing linear and high-gain current-to-voltage conversions. The detection can be done in a linear and a non-linear mode of operation of the circuit, combining the advantages of high-gain in a linear conversion and large dynamic range in a logarithmic conversion in one circuit.

Another object of the invention is to provide a circuit with a simple structure composed of a minimum number of transistors on-chip for efficient current to voltage conversion. The circuit does not require any off-chip capacitors or resistors, and is capable of operating in a linear mode on a single clock.

Yet another object of the current invention is to introduce minimal delay into a current-to-voltage conversion, while allowing an input current varying in a nano-ampere, or even sub-nano, range to be correctly converted.

In accordance with a first aspect of the present invention, there is provided a method for adapting a three-terminal semiconductor device having an operating point and used for current-to-voltage conversion, to a variation of input current level in order to maintain the operation of the device in the linear portion of a curve belonging to a family of i-v curves selected in response to a bias voltage and comprising a linear and a non-linear portion. The three-terminal semiconductor device has an input current terminal, a bias terminal, and a common terminal. A bias voltage between the bias terminal and common terminal controls the current flow between the input current terminal and the common terminal.

The method comprises steps of setting the bias voltage to a preset value in order to position the operating point of the device to an initial value, detecting a change in level of the direct current component of an input current, and adjusting the bias voltage value in response to the change in current level in order to adapt the operating point of the device to an alternate i-v curve so as to remain in the linear portion of a curve.

The current $I_{IN}$ of the device can be set so as to maximize the range of output voltage $V_{OUT}$ by situating the operating point at approximately the middle of the saturation region. Setting the bias voltage to a preset value to position the operating point can be done using a structure of two cascoded transistors, one of which is drain-gate shorted, to sample an input current.

The step of detecting a change in level of an input current can be done upon closing of a switch and the bias voltage of the semiconductor device is adjusted with respect to a newly sampled input current.

In accordance with a second aspect of the present invention, there is provided a circuit to perform current-to-voltage conversion comprising a three-terminal semiconductor device, having an input current terminal, a bias terminal, and a common terminal. A bias voltage between the bias terminal and common terminal controls the current flow between the input current terminal and the common terminal, whereby the output voltage to be measured is present at the input current terminal. The device has an operating point situated on a curve belonging to a family of i-v curves, the curves comprising a linear and a non-linear portion. The circuit also comprises circuitry to detect a level of an input current, and circuitry to adjust the bias voltage value in response to the input current level detected.

More specifically, this can be done by connecting a structure of two cascoded transistors, one of which is drain-gate shorted, to the bias voltage terminal of the three-terminal semiconductor device, and to a clocked transistor, which is connected to the input current terminal of the semiconductor device.

As an alternative, logarithmic mode can also be achieved by simply replacing the clocked transistor by a wire, an off-chip resistance, or a logic gate using a voltage-controlled switch. It is preferable for the entire circuit to reside on an integrated circuit chip but this does not exclude the possibility of having off-chip components.

BRIEF DESCRIPTION OF THE DRAWINGS

The present invention will be better understood by way of the following detailed description of a preferred embodiment with reference to the appended drawings, in which.

DETAILED DESCRIPTION OF THE PREFERRED EMBODIMENT

Figure 1B:
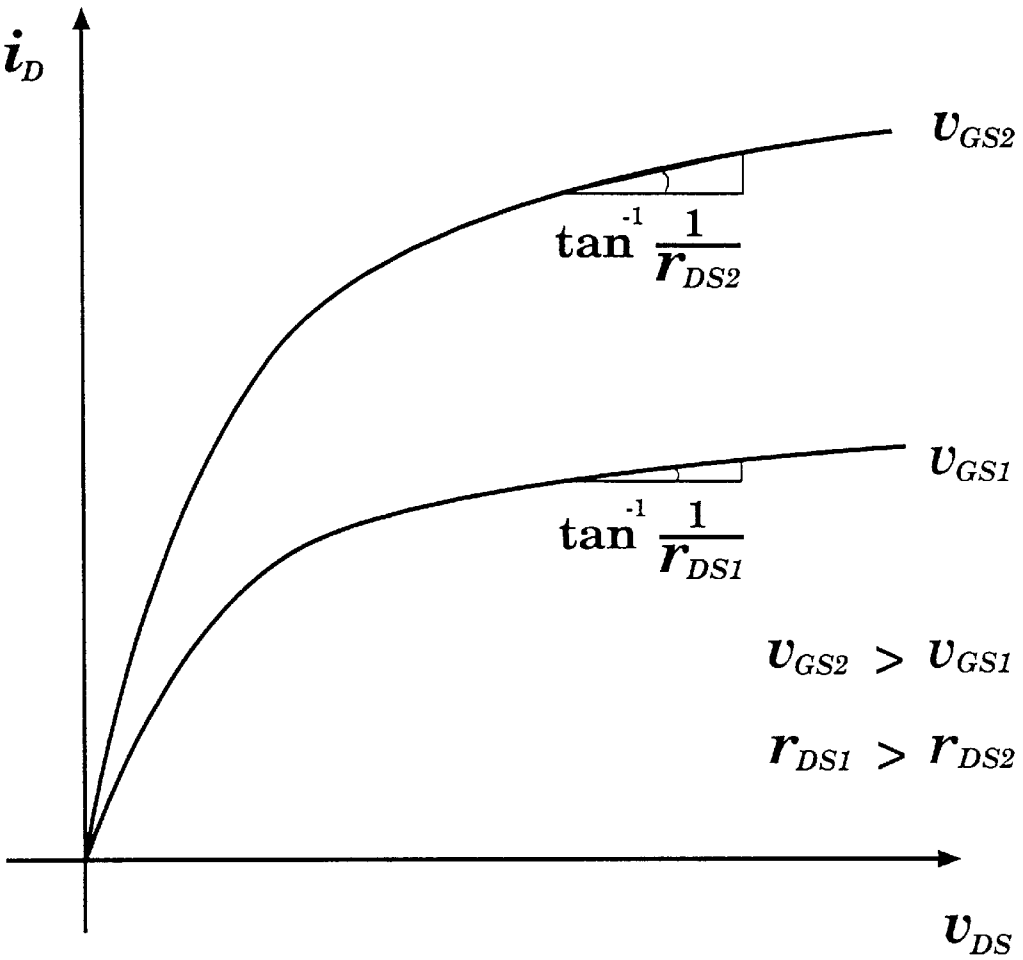
FIG. 1*b* shows a graph of the drain current $i_D$ versus the drain-to-source $V_{DS}$ according to the prior art in which the equivalent drain-to-source resistance of the MOS transistor is given by $r_{DS}=\partial v_{DS}/\partial i_D$ when the gate-to-source voltage is constant.
Figure 1A:
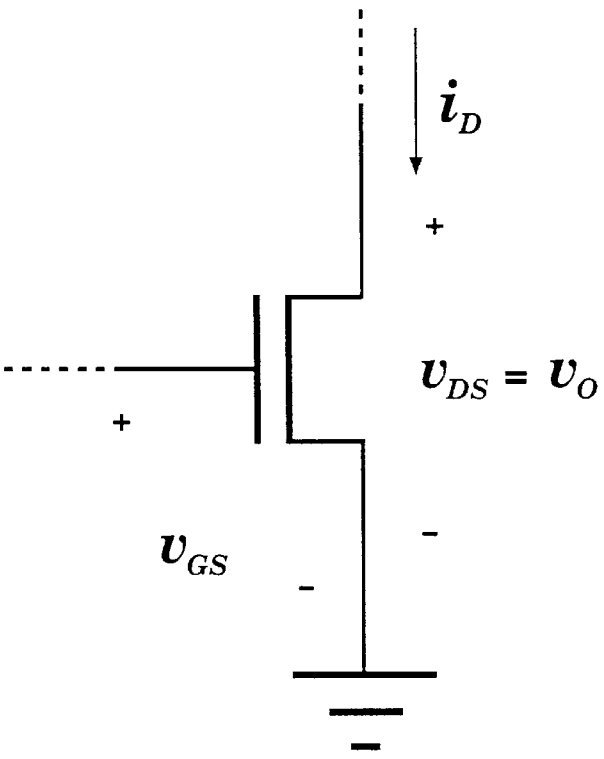
FIG. 1*a* shows a schematic view of a MOS transistor.

FIGS. 1*a* and 1*b* show what happens to a MOS transistor biased in saturation region with its gate-to-source voltage held constant. The equivalent drain-to-source resistance of the transistor ($r_{DS}=\partial V_{DS}/\partial I_D$) has a finite and almost constant value because of channel-length-modulation effect. This equivalent resistance, $r_{DS}$, increases with the decrease of the gate-to-source voltage of the transistor.

Figure 2:
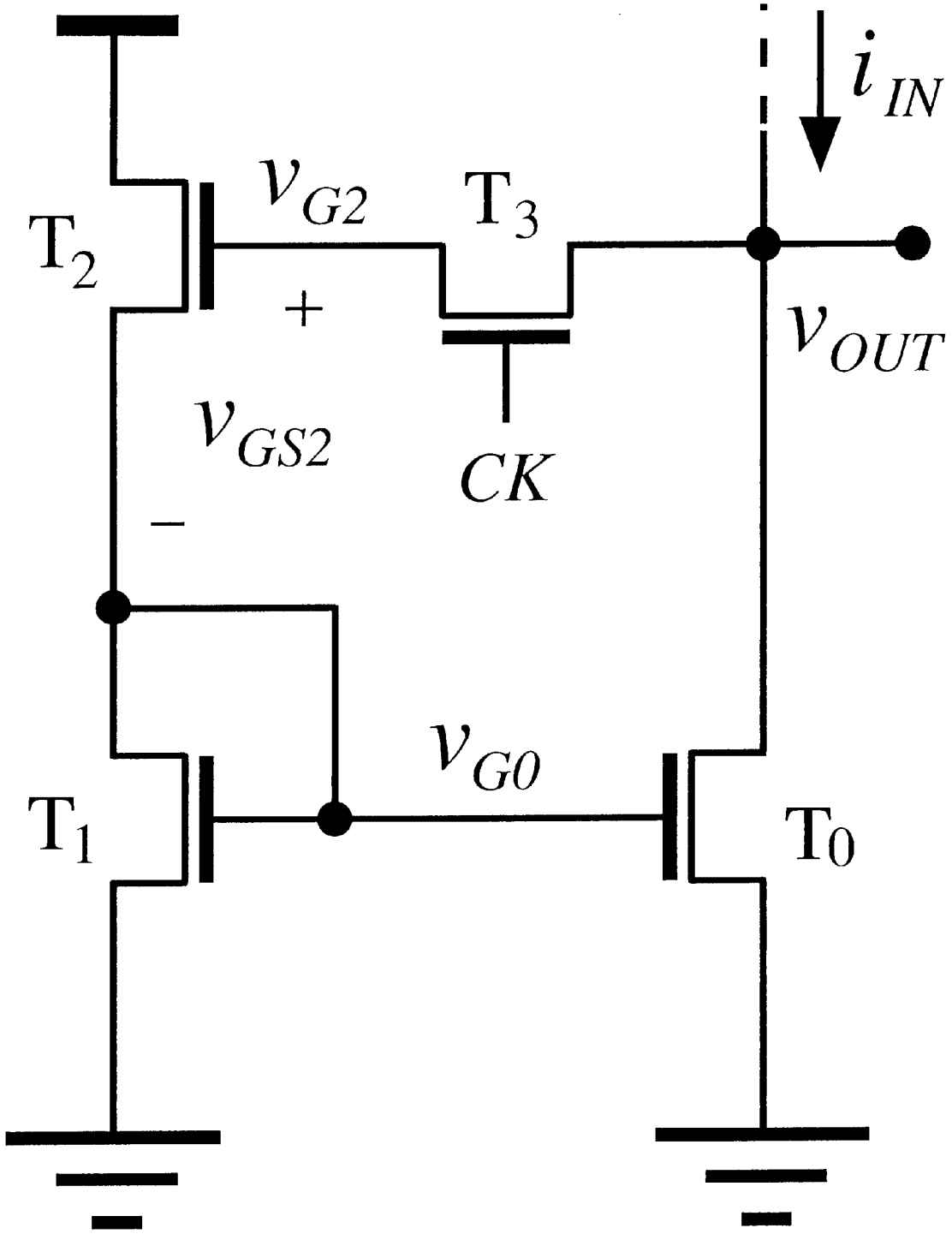
FIG. 2 is a circuit diagram of the current-to-voltage converter according to the preferred embodiment.
Figure 3:
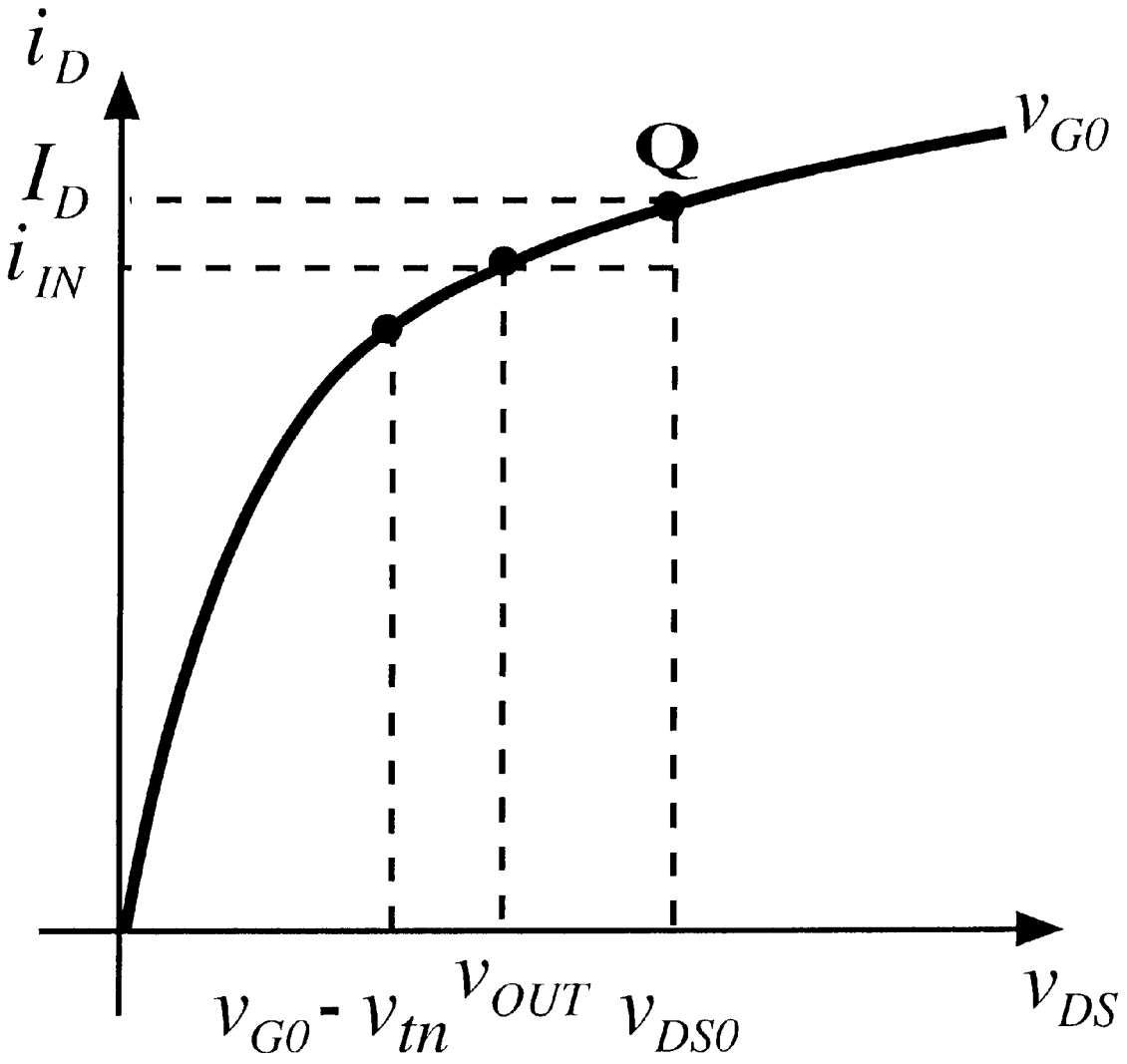
FIG. 3 is a graph illustrating the quiescent point Q ($V_{GO}$, $V_{DSO}$, $I_D$) and an operating point ($V_{GO}$, $V_{OUT}$, $i_{IN}$) of the converting transistor $T_0$. The Q point is set by a reference current $I_D$. If the current changes from $I_D$ to $i_{IN}$ while $V_{GO}$ remains unchanged, $V_{OUT}$ changes from $V_{DSO}$ to $V_{OUT}$. We have $r_{DS}=(V_{OUT}-V_{DSO})/(i_{IN}-I_D)$, which is almost constant if the converting transistor $T_0$ operates in the saturation region. The output voltage $V_{OUT}=r_{DS}(i_{IN}-I_D)+V_{DSO}$ is a linear function of the input current $i_{IN}$.

The circuit diagram of the preferred embodiment for the current-to-voltage converter is illustrated in FIG. 2. The input current $i_{IN}$ can be converted into the output voltage $V_{OUT}$ in different modes:

1/Linear mode when the NMOS switch $T_3$ is off and the transistor $T_0$ operates in the saturation region. In FIG. 3, we can see that, assuming that the gate-to-source voltage of the transistor $T_0$ has been preset to $V_{GO}$ according to a reference current $I_D$, the quiescent point of $T_0$ is at Q ($V_{GO}$, $V_{DSO}$, $I_D$). When the input current changes from $I_D$ to $i_{IN}$, the operating point of $T_0$ will be shifted to ($V_{GO}$, $V_{OUT}$, $i_{IN}$). We have $(V_{OUT}-V_{DSO})/(i_{in}-i_D)=r_{DS}$. The variable $r_{DS}$ is the equivalent drain-to-source resistance of $T_0$ in the saturation region and it is quasi-constant with a given $V_{GO}$. The output voltage is then determined by $V_{OUT}=r_{DS}(i_{IN}-I_D)+V_{DSO}$, varying linearly with $i_{IN}$.

Figure 4:
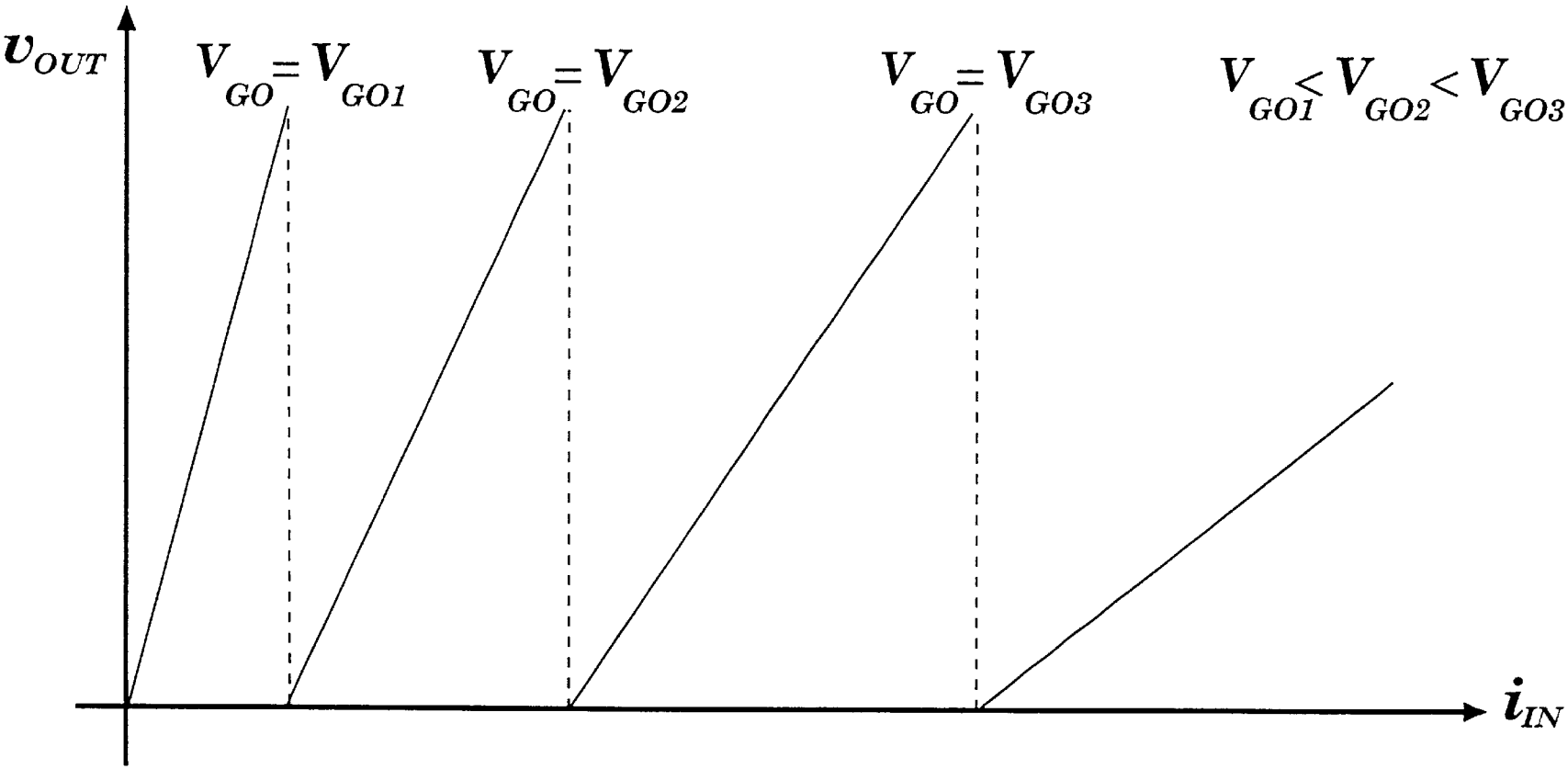
FIG. 4 is a graph of the output voltage versus the input current in the linear conversion mode. $i_{IN}$ and $V_{OUT}$ are linearly scaled. Each $V_{GO}$ determines a current range in which the converting transistor $T_0$ operates in the saturation region and the current-to-voltage conversion is linear. The gain of the linear conversion ($r_{DS}$) increases with the decrease of $V_{GO}$.

In FIG. 4, we can see that a given value of $V_{GO}$ determines a $r_{DS}$ and specifies a current range for a linear conversion. Assuming that the input current can vary from 1 pA to 100 $\mu$A, the variation can be covered by many adjacent ranges. In each range, the converting transistor $T_0$ has a constant gate-to-source voltage $V_{GO}$ and operates in the saturation region. The drain-to-source resistance $r_{DS}$ of $T_0$ is constant within a given range but varies from range to range. A current signal in the lowest range receives the highest $r_{DS}$, i.e. the highest conversion gain. Therefore, an automatic gain control (AGC) can be realized naturally.

Figure 5:
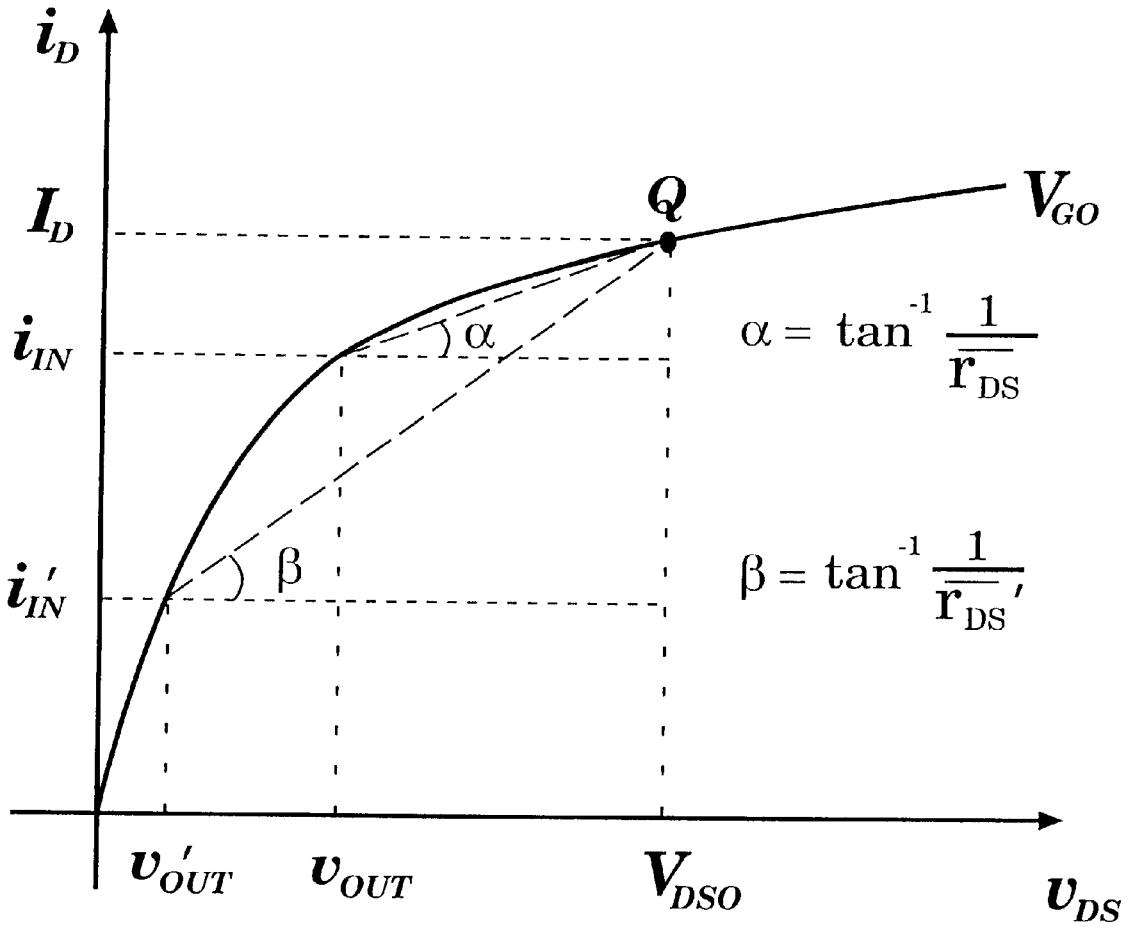
FIG. 5 is a graph of nonlinear conversion with a constant $V_{GO}$. The circuit operation spans the saturation and triode regions. The conversion gain is given by $\text{mean}(r_{DS})=(V_{OUT}-V_{DSO})/(i_{IN}-I_D)$ varying from point to point. When $i_{IN}$ changes to $i_{IN}$,$|i'_{IN}-I'_D|>|i_{IN}-I_D|$ mean($r_{DS}$), changes to mean($r'_{DS}$), mean($r'_{DS}$)<mean($r_{DS}$).
Figure 6:
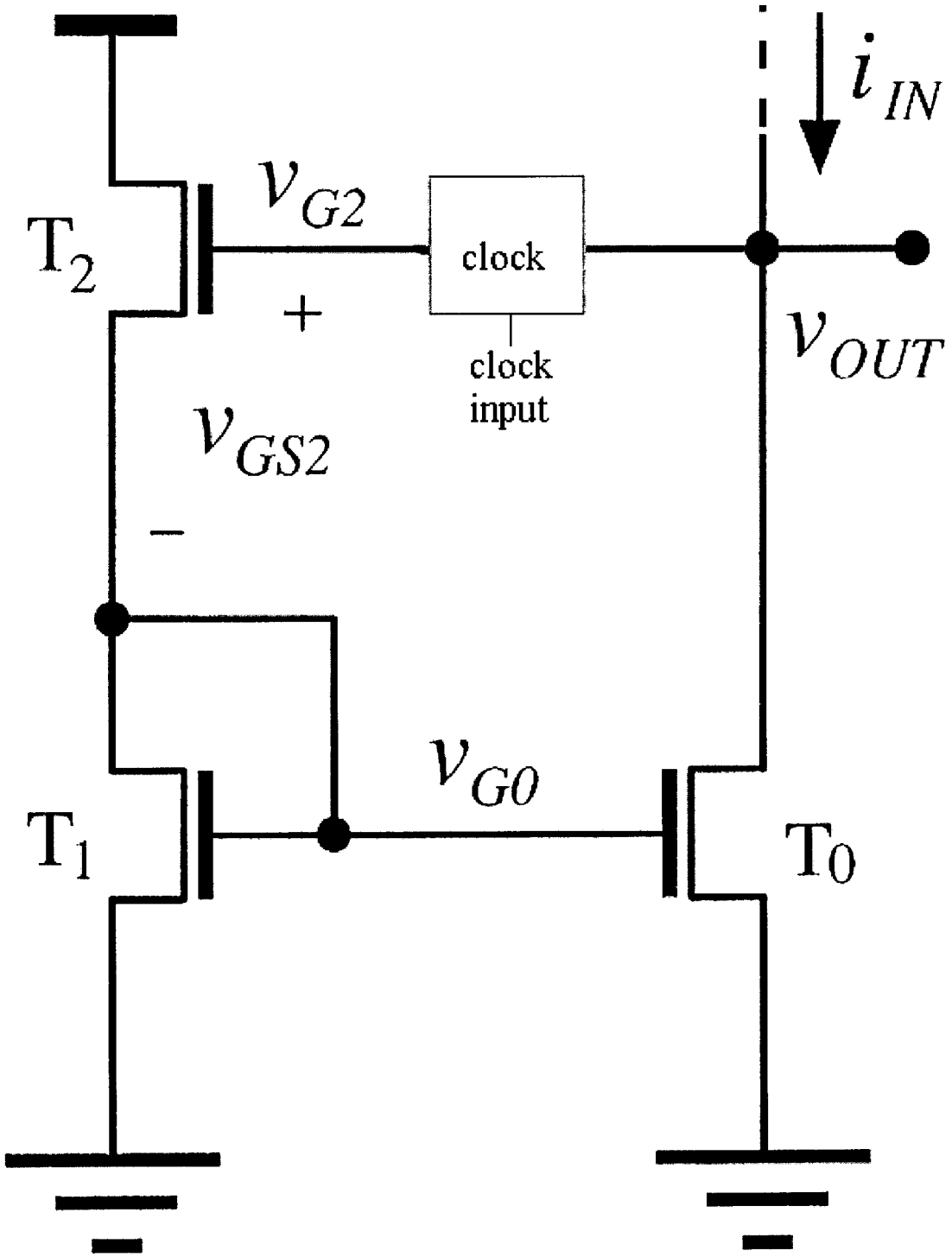
FIG. 6 is a circuit diagram of the current-to voltage converter with a unit for different implementations of the clock.

2/Nonlinear mode when the NMOS switch $T_3$ is off and the transistor $T_1$ overruns the saturation region while $V_{GO}$ is fixed. FIG. 5 shows how this nonlinear mode extends the conversion in case of a large current difference $|i_{IN}-I_D|$. The ratio decreases when $|i_{IN}-I_D|$ increases. Thus, while keeping a gain of a linear conversion high for small current variations, a compressed gain is automatically applied when the current variation is large. The dynamic range of the input current is, therefore, widened by the nonlinear operation.

3/Logarithmic mode when NMOS switch $T_3$ is on. The loop consisting of $T_0$, $T_1$ and $T_2$,seen in FIG. 2, is closed. The output voltage $V_{OUT}=V_{GO}+V_{GS2}$, where $V_{GS2}$ is the gate-to-source voltage of $T_2$. As the current flowing in the transistors $T_1$ and $T_2$ is mirrored from $i_{IN}$, both $V_{GO}$ and $V_{GS2}$ vary with $i_{IN}$. If the input current $i_{IN}$ is well below one micro-ampere, $T_0$, $T_1$ and $T_2$ operate in weak inversion mode, the characteristic $V_{OUT}$ versus $i_{IN}$ will be logarithmic. If the input current $i_{IN}$ is in micro-ampere range, $V_{OUT}$ versus $i_{IN}$ follows square-root rule.

It should be noticed that a linear conversion can be obtained only if the input current $i_{IN}$ is comparable to the reference $I_D$ in terms of magnitude. Thus, implementing an adaptive process to set up a suitable quiescent point ($V_{GO}$, $V_{DSO}$, $I_D$) for an unknown current signal is a key issue in the circuit design. As an input current signal is usually composed of a small varying component superposed on a large DC component, the Q point can be set up by the input current: When $T_3$ is turned on, the input current creates a voltage at the node $V_{OUT}$. This voltage is sampled and a corresponding $V_{GO}$ is established. Then, when $T_3$ is turned off, the sampled voltage serves to establish the reference current which adapts automatically to the input current range.

The two transistors, $T_2$ and drain-gate-shorted $T_1$, forming a cascoded structure, function as the following:

(1) Positioning the quiescent operating point (Q point) of the converting transistor $T_0$ at, approximately, the middle of the saturation region to maximize the range of the output voltage $V_{OUT}$. The MOS switch $T_3$ is on to set up the Q point. In this case, we have $V_{DSO}=V_{GO}+V_{GS2}>V_{GO}-V_{tn}$, $V_{tn}$ is the threshold voltage of the converting transistor $T_0$ and $V_{DS}=V_{GO}-V_{tn}$ is the boundary point of the saturation region (see FIG. 1*b*). Thus, in terms of drain-to-source voltage, the distance between the boundary point and the Q point is $V_{GS2}+V_{tn}$, almost the half-range of the drain-to-source voltage of $T_0$ for the saturation mode.

(2) Attenuating the effect of charge injection. The MOS switch $T_3$ is on to set up a Q point and then is off for a current conversion. Switching $T_3$ off can shift the Q point. The cascoded structure of $T_1$ and $T_2$ reduces this shift. When $T_3$ is turned off, charge released from the channel of $T_3$ is injected into the connected gate node $V_{G2}$ which is not the critical gate node $V_{GO}$ of the converting transistor $T_0$. The charge injection produces a small voltage variation $\Delta V_{G2}$ (see the article by WILSON, W. B., MASSOUD, H. Z., SWASON, E. J., GEORGE, R. T. and FAIR, R. B.: 'Measurement and Modeling of charge feed-through in n-channel MOS analog switches', IEEE J. Solid-State Circuits, 1985, SC-20, pp. 1206–1213) which is then transferred to the node $V_{GO}$, resulting in a variation of $\Delta V_{GO}$, i.e. a shift of the Q point. The voltage transfer function for small signal is given by:

$$(\Delta V_{GO}/\Delta V_{G2})=(1)/(1+(g_{m1}/g_{m2})+(g_{mb2}/g_{m2})+((1/g_{m2})\cdot(1/r_{01}\|_{r\cdot 02\cdot})))<1,$$

where $g_{m1}$ and $g_{m2}$ are, respectively, the transconductances of the $T_1$ and $T_2$, $r_{01}$ and $r_{02}$ are their output resistances, and $g_{mb2}$ is the body-transconductance of $T_2$. If $g_{m1}=n_{gm2}$ and n>1, we will have $\Delta V_{GO}\approx\Delta V_{G2}/(1+n)$. Thus, the voltage variation caused by the charge injection will be reduced by a factor of (1+n).

(3) Accelerating the Q point set-up. When $T_3$ is on, $T_0$, $T_1$, $T_2$and $T_3$ form a negative feedback loop facilitating a quick establishment of $V_{GO}$.

(4) Eliminating voltage variation coupling form the output node $V_{OUT}$ to the gate nodes of $T_0$, $T_1$ and $T_2$ respectively. When $T_3$ is off, there is no current path connecting the node $V_{G2}$ to the rest of the circuit. As CK=0, the voltage variation at the node $V_{OUT}$ cannot be coupled to the node $V_{G2}$. Therefore, the gate voltage $V_{G2}$ is constant and so is the current flowing through the cascoded transistors $T_1$ and $T_2$. This current determines the value of $V_{GO}$. $V_{GO}$ is thus constant and independent of the output voltage $V_{OUT}$.

The invented circuit appeals by its high conversion gain combined with a wide current range (sub-nA up to 100 $\mu$A), real-time operation, and simplicity which signifies small silicon surface and low power dissipation. Moreover, its implementation and application can be facilitated by deepening-sub-micron technology. A great importance of its applications in VLSI is anticipated, because 1) The importance of developing current-mode signal processing circuits is growing as the voltage swing is decreasing with shrinking transistor feature size. The invented circuit can be used in current signal processing, e.g. detection of current derivative. Moreover, in current mode circuits, the final signals to be outputted are voltages, high speed and simply-structured current-to-voltage converters are always needed.

2) Optical signal processing is getting more and more involved in VLSI, for instance, in CMOS image sensors or industrial robots. Photocurrents converted from luminous flux can cover a very wide range (e.g. six decades can be expected) which is difficult for an electronic circuit to match without lowering its sensitivity of signal detection. The invented circuit can perform, in a very wide range, a high-gain detection of current variation while removing the slowly varying signal component (e.g. the signal of the background). Furthermore, as the circuit is very simple, it fits large scale integration of CMOS optical sensors for high-resolution two-dimensional signal sensing and processing.

The present invention is a multi-mode current-to-voltage converter. The proposed converter can operate in a linear mode or non-linear mode. In the linear mode, the output voltage varies linearly with the variation of the input current with respect to a reference level which adapts automatically to the input current level. The conversion gain depends on the current level. The lower the current level, the higher the gain. The converter is operational in a dynamic range of sub-nano-Amperes to 100 micro-Amperes, corresponding to a range of conversion gain of IV/nA to 0.03V/uA. The conversion is performed instantaneously after the initial process for the reference set-up. If the current level is in a micro-Ampere range, the time required for the initial process is a couple of nano-seconds and the operating frequency can reach 100 MHz or more.

In the non-linear mode, the output voltage of the converter varies logarithmically with the input current. The conversion is performed without delay. The time required for the initial process is the same as that in the linear mode.

Transistor T3 in FIG. 2, operating as a clock transistor, can be replaced by a resistance for a slower logarithmic mode. This resistor would have to be off-chip due to its size but it could serve the same function as the clocked transistor T3. Another alternative to the clocked transistor is a logic inverter using a voltage-controlled switch. This component could be off-chip or on-chip. It is preferable for the entire circuit to reside on-chip but this does not exclude the possibility of using only discrete components to build the circuit and having each of these components off-chip.

An alternative to the preferred embodiment is the use of two comparators instead of transistors. For set current ranges such as those seen in FIG. 4, the comparators would act as voltage detectors and when the voltage level is detected to be below or above an acceptable value, the bias voltage of transistor T0 would be shifted and the operation of transistor T0 would be described by an alternate i-v curve, maintaining the operating point of T0 within a linear portion of an i-v curve. The comparators would replace the circuitry composed of transistors T1, T2, and T3.

What is claimed is:

1. A method for adapting a semiconductor device having an operating point and used for current-to-voltage conversion, to a variation of input current in order to maintain the operation of the device in a substantially linear portion of a saturation region of a curve belonging to a family of i-v curves selected in response to an input voltage and comprising a linear and an adjacent non-linear portion, wherein said semiconductor device has at least an input current terminal, a bias terminal, and a common terminal, whereby a bias voltage between said bias terminal and said common terminal controls a rate of voltage variation at said input current terminal according to said variation of input current, and the output voltage is present at said input current terminal, said method comprising:

setting said bias voltage to a preset value in order to position said operating point of the device to an initial value in the saturation region;

detecting a change in level of a direct current component of said input current; and adjusting the bias voltage value in response to said change in order to adapt said operating point of the device to an alternate i-v curve so as to remain in the substantially linear portion of the saturation region of a curve.

2. The method as defined in claim 1, further comprising setting the current $I_{IN}$ of said device so as to maximize the range of output voltage $V_{OUT}$ by situating said operating point at approximately a middle of a saturation region.

3. The method as defined in claim 1, wherein said step of setting said bias voltage to a preset value further comprises providing a structure of two cascoded transistors, of which one is drain-gate shorted, to position said operating point of said device.

4. The method as defined in claim 1, wherein said step of setting said bias voltage to a preset value further comprises sampling an input current to set up a corresponding bias voltage to initially set said operating point of said device.

5. The method as defined in claim 1, wherein said step of detecting a change in level of the direct current component of an input current further comprises attenuating the effect of charge injection into said device upon closing of a switch.

6. The method as defined in claim 1, wherein said steps of detecting a change in level of the direct current component of an input current and adjusting the bias voltage value in response to said change further comprises sampling a new input current to adjust said bias voltage to a new corresponding value.

7. The method as defined in claim 1, further comprising multi-mode current-to-voltage conversion, wherein an output voltage can vary linearly or logarithmically with the variation of an input current level.

8. A current-to-voltage converter circuit comprising:

a semiconductor device having at least an input current terminal, a bias terminal, and a common terminal, whereby a bias voltage between said bias terminal and said common terminal controls the rate of voltage variation at said input current terminal according to the variation of input current, whereby the output voltage is present at said input current terminal, said device having an operating point situated in a substantially linear portion of a saturation region on a curve belonging to a family of i-v curves, said curves comprising a linear and an adjacent non-linear portion; and circuitry adjusting said bias voltage value in order to adapt said operating point of said device to a detected input current level, whereby said current-to-voltage converter circuit remains within a linear portion of the saturation region of said curve yielding a large voltage difference for a small change in said input current while said circuit adapts to changes in a DC component in said input current.

9. A circuit as defined in claim 8, wherein said adjusting circuitry comprises a structure of two cascaded transistors, one of which is drain-gate shorted, connected to said bias terminal of said semiconductor device, said transistors having a predetermined width/length ratio.

10. A circuit as defined in claim 8, wherein the width/length ratio of a first one of said two cascoded transistors is greater than the width/length ratio of said drain-gate shorted second transistor of said cascoded structure and the width/length ratio of said device is as small as is allowed by the technology.

11. A circuit as defined in claim 9, further comprising detecting circuitry wherein a clocked transistor is connected to a gate of a first one of said two cascaded transistors, and to said input current terminal of said semiconductor device.

12. A circuit as defined in claim 9, wherein said cascaded structure is connected to said node of said output voltage by means of a wire.

13. A circuit as defined in claim 9, wherein said cascaded structure is connected to said node of said output voltage by means of a resistor.

14. A circuit as defined in claim 9, wherein said cascaded structure is connected to said node of said output voltage by means of a logic gate using a voltage-controlled switch.

15. A circuit as defined in claim 11, wherein the width and length of said clocked transistor are the minimum allowed in the technology.

16. A circuit as defined in claim 11, wherein said circuitry resides on an integrated circuit chip.

17. A circuit as defined in claim 12, wherein said circuitry resides on an integrated circuit chip.

18. A circuit as defined in claim 13, wherein said circuitry resides on an integrated circuit chip.

19. A circuit as defined in claim 14, wherein said circuitry resides on an integrated circuit chip.

* * * * *